US007304555B2

(12) United States Patent
Wang et al.

(10) Patent No.: US 7,304,555 B2
(45) Date of Patent: Dec. 4, 2007

(54) PERMALLOY LOADED TRANSMISSION LINES FOR HIGH-SPEED INTERCONNECT APPLICATIONS

(75) Inventors: Pingshan Wang, Carbondale, IL (US); Edwin C. Kan, Saratoga, CA (US)

(73) Assignee: Cornell Research Foundation, Inc., Ithaca, NY (US)

( * ) Notice: Subject to any disclaimer, the term of this patent is extended or adjusted under 35 U.S.C. 154(b) by 0 days.

(21) Appl. No.: 11/018,924

(22) Filed: Dec. 22, 2004

(65) Prior Publication Data

US 2005/0212627 A1 Sep. 29, 2005

Related U.S. Application Data

(60) Provisional application No. 60/530,897, filed on Dec. 22, 2003.

(51) Int. Cl.
*H01P 3/08* (2006.01)

(52) U.S. Cl. ..... 333/238

(58) Field of Classification Search ..... 333/238
See application file for complete search history.

(56) References Cited

U.S. PATENT DOCUMENTS

| | | | | |
|---|---|---|---|---|
| 3,657,075 | A * | 4/1972 | Oshima et al. | 205/119 |
| 3,780,789 | A * | 12/1973 | Unger | 164/420 |
| 3,972,786 | A * | 8/1976 | Ballard | 205/118 |
| 6,323,468 | B1 * | 11/2001 | Dabelstein et al. | 219/617 |
| 6,781,486 | B2 * | 8/2004 | Killen et al. | 333/204 |
| 6,914,278 | B2 * | 7/2005 | Forbes et al. | 257/225 |

* cited by examiner

*Primary Examiner*—Robert Pascal
*Assistant Examiner*—Kimberly E Glenn
(74) *Attorney, Agent, or Firm*—Jones, Tullar & Cooper, P.C.

(57) ABSTRACT

To facilitate high frequency operation, transmission lines for high-speed interconnect applications in CMOS technologies are loaded with patterned permalloy or other ferromagnetic material films. Patterning the permalloy films as a plurality of segments results in control of the domain structures in the permalloy segments such that ferromagnetic resonance (FMR) effects are eliminated and eddy-current effects are reduced, thereby allowing operation of the transmission lines at frequencies of 20 GHz or higher. In addition, the patterned permalloy reduces the magnetic field coupling between two adjacent transmission lines. A novel ferromagnetic thin film characterization method is also employed to measure the microwave permeability of the patterned permalloy films and verify their high frequency operational characteristics.

18 Claims, 5 Drawing Sheets

PERMALLOY LOADED TRANSMISSION LINES FOR HIGH-SPEED INTERCONNECT APPLICATIONS

CROSS REFERENCE TO RELATED APPLICATIONS

This application claims the benefit, under 35 U.S.C. 119(e), of U.S. Provisional Application No. 60/530,897, filed Dec. 22, 2003, which is hereby incorporated by reference.

BACKGROUND OF THE INVENTION

1. Field of the Invention

The present invention relates in general to transmission lines that are loaded with patterned permalloy or other ferromagnetic material to control domain structure orientation in the ferromagnetic material and thereby facilitate an increase in operating frequency limits for the transmission line. In addition, the patterned permalloy provides magnetic shielding. The invention also includes a novel technique for characterizing high frequency parameters of the patterned permalloy or other ferromagnetic material.

2. Description of the Background Art

Mutual inductance and self-inductance of global interconnects are crucial factors of integrated circuit performance but are difficult to extract and model in deep sub-micrometer VLSI designs. The self-inductance of signal lines helps save power by reducing signal rise times and by reducing the number of required repeaters, which in turn saves on chip area. Depending upon the circuit conditions, the signal propagation delay is either improved or not much affected when higher inductance is involved. However, mutual inductance complicates the system design dramatically through crosstalk. In fact, mutual inductance may limit the maximum usable line length when wide separations for intralayer crosstalk containment are employed.

To tackle the mutual inductance crosstalk problem, several methods have been used previously, including use of large spacing between the interconnect lines, close-by ground planes (if the targeted line impedance can still be achieved), and shorter parallel run lengths between signal lines. Unfortunately, each of these known methods share the same drawback that they deteriorate the data rate capacity of the available routing resources.

The complications are also exemplified by the difficulties in interconnect inductance extraction and modeling. Both self and mutual inductances are long-range effects and depend on the current return path, which is unknown prior to extracting and simulating the entire nonlinear circuit. As a result, no full-chip inductance extraction method is available without localization assumptions, even with the help of the partial inductance method.

It is known that magnetic materials can be used to suppress mutual inductance and provide magnetic shielding. However, for high speed VLSI applications, the magnetic materials must work in the microwave frequency range with large saturation magnetization and small coercive forces. Insulating ferrites are difficult to use because of their low saturation magnetization and CMOS process incompatibility. On the other hand, thin film ferromagnetic materials, such as permalloy, are promising for high-speed interconnect and monolithic microwave device applications due to their high permeability and CMOS compatible fabrication processes. However, ferromagnetic resonance (FMR) and eddy-current loss have limited their high-frequency applications until now. Sustained efforts in increasing the natural FMR frequency have not been very successful so far. As a result, a strong DC magnetic field, which can be very cumbersome, is usually applied for microwave applications to control FMR effects. The previous efforts to restrain FMR and eddy-current losses in as-deposited permalloy films have shown that geometry design is effective up to 6 GHz. However, this frequency is not high enough for future high-speed on-chip interconnect applications, which require operational frequencies up to 20 GHz.

The lack of accurate high-frequency characterization methods is another obstacle in developing monolithic ferromagnetic microwave devices. It has been demonstrated that up to 6 GHz, thin ferromagnetic films can be accurately characterized by the use of a signal coil technique. For broader frequency ranges, the published methods have one restriction or another. For instance, one broadband transmission line method is restricted to flexible ferromagnetic ribbons or wires, while other proposed methods require approximate theoretical expressions. Another problem with current VLSI designs is the lack of effective mutual magnetic field shielding, which limits the maximum un-buffered interconnect line length.

In view of the foregoing, a need therefore remains to develop a CMOS compatible technology that can suppress the effects of FMR and eddy currents to facilitate high frequency operation in the 20 GHz range. In addition, the technology should be able to suppress the mutual inductance, simplify the inductance extraction and modeling and increase the interconnect self-inductance. It is also desirable that the new technology provide magnetic field shielding capabilities yet preserve the data rate capacity of the given routing resources. A need also remains for a suitable high frequency characterization method for ferromagnetic microwave devices.

SUMMARY OF THE INVENTION

The present invention addresses the foregoing needs through provision of global interconnect transmission lines that have magnetic materials incorporated therein which overcome the aforementioned limitations. More particularly, the invention is directed toward transmission line structures or the like that are loaded with patterned ferromagnetic material, such as permalloy. Permalloy is a well known nickel-iron alloy that contains between 20 and 60% iron. In the preferred embodiments, the permalloy is formed in a pattern of a plurality of parallel spaced permalloy bars or segments that are positioned perpendicular to the transmission line conductor and are either in contact therewith or spaced there from by a thin insulating layer. By patterning the permalloy in this manner, it has been found that the domain structures that are formed in the permalloy bars when they are magnetized are arranged in an orientation that is perpendicular to the longitudinal axis of the transmission line. This results in elimination of FMR effects and a substantial reduction in eddy current losses. Through experimentation, the inventors have discovered that the use of thin permalloy bars with small domain cross sectional areas (e.g. 2 μm or less in width) and very small spacing between them (e.g. 10 nanometers to 2 μm) substantially reduces the adverse effects of eddy currents. As a result, experiments have shown that the patterned permalloy loaded transmission lines can operate at frequencies up to the 20 GHz range. In addition, the use of the patterned ferromagnetic materials has been found to provide effective magnetic field shielding.

During research on test transmission line structures loaded with patterned permalloy in accordance with the preferred embodiments, a novel technique was also discovered that can identify the high frequency operational characteristics of the permalloy loading using only circuit parameters that are extracted from the permalloy loaded transmission line using a network analyzer or the like. The network analyzer is first used to extract the scattering parameters for the permalloy loaded line, which are then used to calculate the circuit parameters for the line. Next, the resistance and inductance parameters of a comparison transmission line that has no permalloy loading are determined. These are subtracted from the same parameters for the loaded line to determine the resistance and inductance parameters of the permalloy alone. These values can then be input into a formula that calculates the permeability of the permalloy loading as a function of frequency. This value can then be employed to determine the upper frequency limit for the permalloy loaded transmission line.

BRIEF DESCRIPTION OF THE DRAWINGS

The features and advantages of the present invention will become apparent from the following detailed description of a preferred embodiment thereof, taken in conjunction with the following drawings, in which.

DETAILED DESCRIPTION OF THE PREFERRED EMBODIMENTS

During the design of a transmission line that is loaded with ferromagnetic material in accordance with the preferred embodiments of the present invention, the following design considerations were addressed. It should first be noted that the design is particularly of interest for use in high frequency CMOS applications, such as CMOS Rf integrated circuits. The nickel-iron alloy known as permalloy is compatible with CMOS applications and is thus the preferred choice for the ferromagnetic material. However, it will be understood that other ferromagnetic materials could be used as well. FMR and eddy-current losses are the limiting factors for high-frequency permalloy applications and must therefore be eliminated or substantially reduced. The analysis of the issues follows.

Figure 1A:
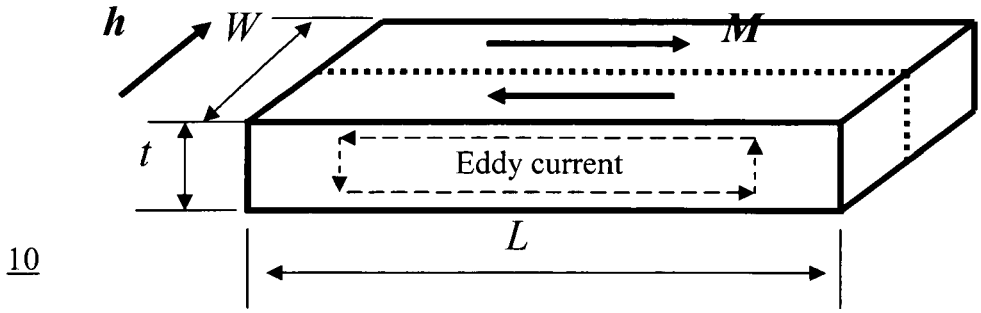
FIG. 1A is a schematic illustration of the eddy currents in a ferromagnetic thin film or bar under high-frequency magnetic field excitation, $h=h_{max}\cos(\omega t)$, where h is along the hard axis of the ferromagnetic film.

The macroscopic equation of motion of the magnetization vector, without the damping terms, is:

$$\frac{d(\vec{M}_0+\vec{m})}{dt} = -\gamma_m((\vec{M}_0+\vec{m})\times(\vec{H}_0+\vec{h})) \tag{1}$$

where $M_0$ and m are the static and high frequency magnetizations respectively; $H_0$ and h are the static and high frequency magnetic fields respectively. Domain magnetization rotation and precession of the magnetization vector occur when $M_0$ and $H_0$ are perpendicular to h, as is shown in FIG. 1A which illustrates the eddy current in a ferromagnetic thin film 10. As a result, the natural (no external DC magnetic field) FMR frequency of thin films is closely related to the fundamental material properties and is defined by Equation (2):

$$\omega_r=\gamma_m\sqrt{(H_0+H_a)(H_0+H_a+4\pi M_s)} \tag{2}$$

where $\gamma_m=1.76\cdot10^{11}/T\cdot s$ is the gyromagnetic ratio, $H_0$ the DC magnetic field, $H_a$ the anisotropy field and $4\pi M_s$ the saturation magnetization. This frequency is low (in the lower GHz range in general) for permalloy because of its nearly zero anisotropy. Above the FMR frequency, the real part of the permeability is negative. As a result, a strong external magnetic filed, $H_0$, is usually employed for microwave applications employing permalloy to replicate the domain structures illustrated in the ferromagnetic thin film 12 shown in FIG. 1B. These issues overshadow the perspective applications of permalloy in high-speed interconnects where $H_0$ is not easily available. However, a detailed examination of Equation (2) shows that it applies to the domain structures in the film 10 in FIG. 1A, but not to those in the film 12 in FIG. 1B. In particular, when the high-frequency magnetic field is along the hard axis of the domain structures as in the film 10, FMR occurs. On the other hand, when the easy axis of the domain structures is in the direction of an external high-frequency magnetic field as in the film 12 in FIG. 1B, FMR effects are eliminated. In this case, domain wall motion is the magnetization process and eddy-current loss (the domain wall motion loss) is the frequency limiting factor.

Figure 1C:
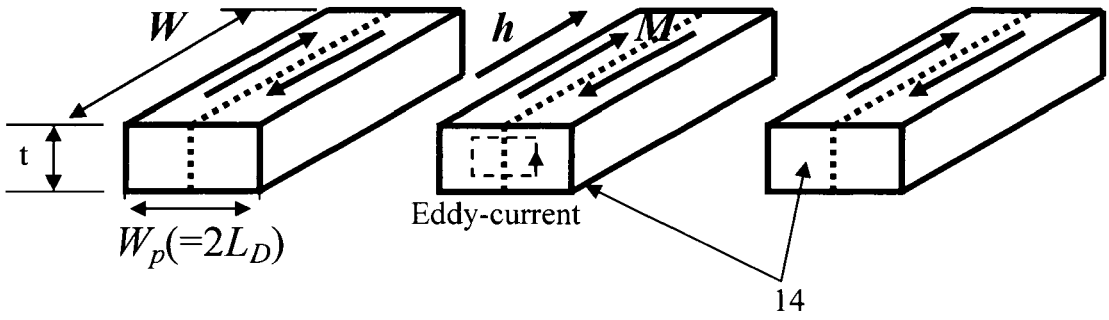
FIG. 1C is a schematic illustration of the eddy currents in ferromagnetic thin films or bars that are employed in a preferred embodiment of the present invention.
Figure 1B:
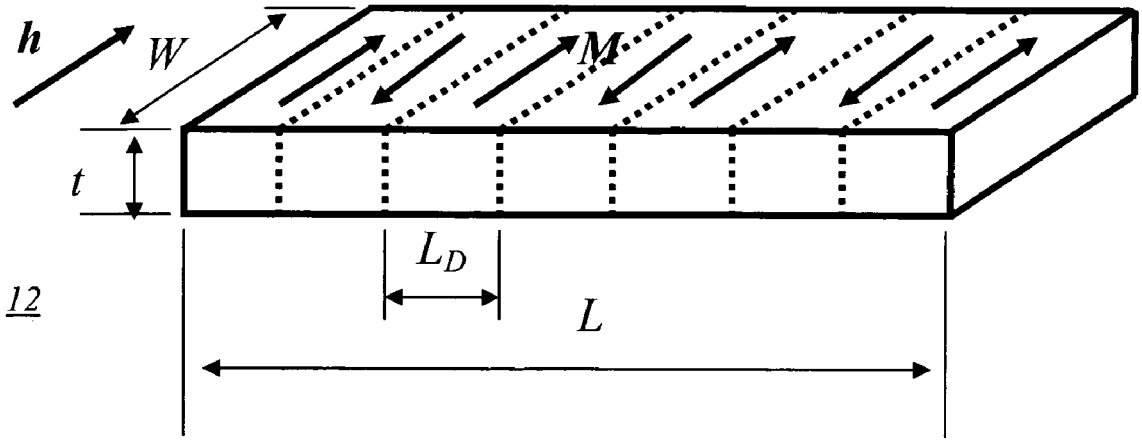
FIG. 1B is a schematic illustration of the eddy currents in a ferromagnetic thin film or bar under high-frequency magnetic field excitation, $h=h_{max}\cos(\omega t)$, where h is along the easy axis of the ferromagnetic film.

The domain structure of a thin, narrow permalloy film is thus similar to that of the film 10 in FIG. 1A in which FMR effects are not limited, while an external magnetic field is required for forming the domain structures in the film 12 in FIG. 1B. However, the inventors have discovered that geometry design using a conventional lift-off process can be used to form domain structures similar to what is shown in FIG. 1C in which a plurality of spaced ferromagnetic film segments or bars or the like 14 are employed to simulate the same domain structures of FIG. 1B without the need to use an external magnetic field.

Once FMR is under control, eddy-current (domain wall motion) is then the limiting factor. Eddy-current losses in the films 10 and 12 in FIGS. 1A and 1B can be expressed as:

$$\frac{P_{eddy}}{\text{volume}} \propto \frac{h_{\max}^2\omega_s^2}{\rho} \tag{3}$$

where ρ is the resistivity of bulk permalloy, $h_{max}$, the high-frequency magnetic field strength, ω, the angular frequency of the applied magnetic field and s the domain cross section area, which is t·L for the film 10 in FIGS. 1A and $t\cdot L_D$ for the film 12 in FIG. 1B.

Equation (3) shows that geometry designs controlling the cross-section area can effectively limit the eddy-current loss because the loss is proportional to the cross sectional area of the domain. The transverse magnetic field associated with the transmission lines can be assumed parallel to the length direction of the patterned permalloy bars, where different cross-section areas can be designed for the FMR and eddy-current control. For narrow permalloy bars, $2L_D$ is expected to be $W_p$. As a side note, patterned magnetic materials are sometimes referred to as artificially nano-structured films. Equation (3) also indicates that if a large number of bars are used ($W_p$ small), the eddy current loss can be greatly alleviated. This method is also more efficient than increasing the resistivity of the material.

Figure 2A:
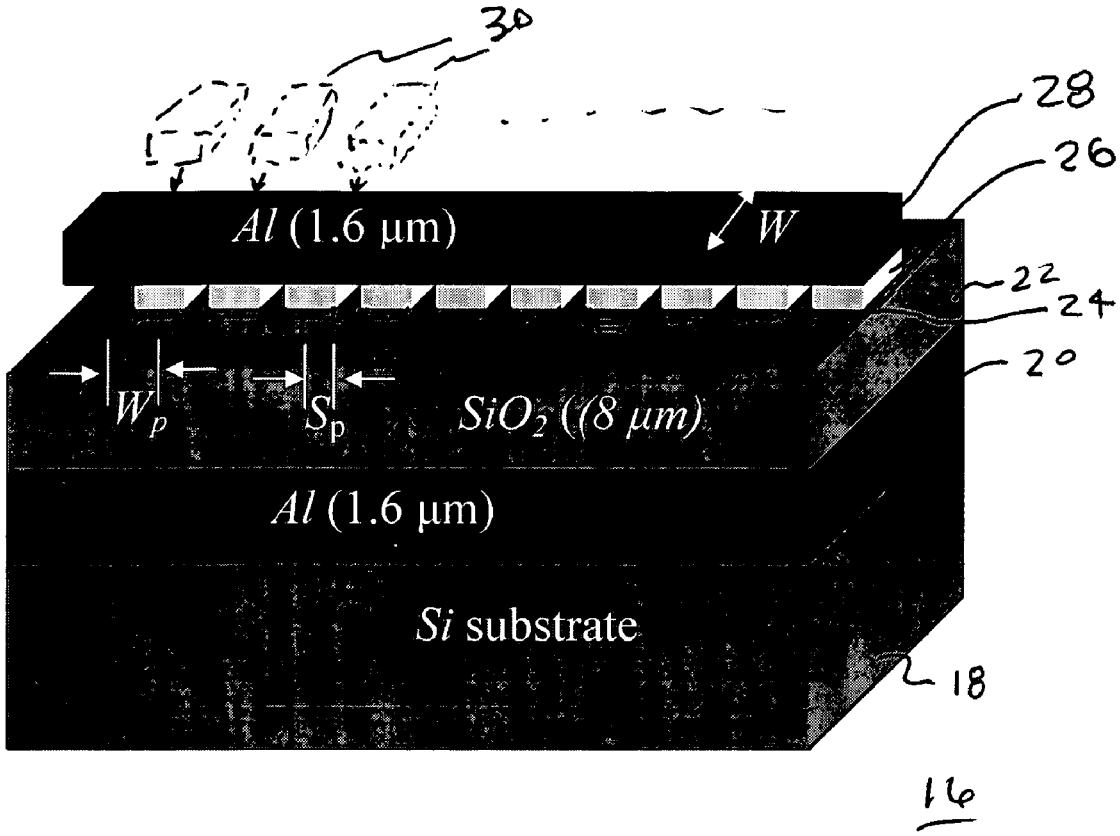
FIG. 2A is a schematic illustration of a transmission line that is loaded with a pattern of ferromagnetic films or bars in accordance with a first preferred embodiment.

In order to verify the theory behind the present invention, four test transmission line structures were fabricated that each replicate the domain structure in the films 14 in FIG. 1C. FIG. 2A illustrates the design shared by these four test structures and comprises a first preferred embodiment of the invention. The fabrication process used in forming the test structures follows. It will of course be understood that the invention is not limited to the use of this specific process and any suitable fabrication process can be used. In FIG. 2A, a transmission line 16 is shown which includes a standard silicon substrate 18, on top of which a 1.6 μm-thick aluminum film 20 is sputtered as the ground plane for the transmission line 16. An approximately 8 μm thick $SiO_2$ insulating layer 22 is then deposited on the film 20 using plasma enhanced chemical vapor deposition (PECVD) at a rate of 460 nm/minute. A thin insulating layer 24 of tantalum (Ta) or other suitable material such as $SiO_2$ approximately 20 nm thick is evaporated as the adhesion and diffusion barrier layer. This is followed by permalloy evaporation that forms a plurality of permalloy bars or film segments 26, each approximately 200 nm thick, on the insulating layer 24.

In the fabrication of the test samples, no external magnetic field was applied during the deposition process to control the anisotropy of the deposited material. No thermal or magnetic field annealing was performed. The insulating Ta layer 24 is expected to have negligible effects on the deposited permalloy films. The target material for permalloy evaporation was from commercial $Ni_{80}Fe_{20}$ slugs. The patterning of the Ta layer 24 and the permalloy thin film bars or segments 26 were both done using a conventional lift-off process. A second approximately 1.6-μm thick aluminum layer 28 was then sputtered and patterned by dry-etch on top of the permalloy bars 26 which acts as the transmission line conductor.

In a variation that was not employed in the four test structures, a second set of patterned permalloy bars 30 can be formed on the top side of the conductor layer 28 as illustrated by the dashed lines in FIG. 2A. Sandwiching the A1 line conductor 28 with patterned permalloy films on both sides in this manner can further increase the inductance and magnetic field shielding properties of the transmission line 16.

Figure 2B:
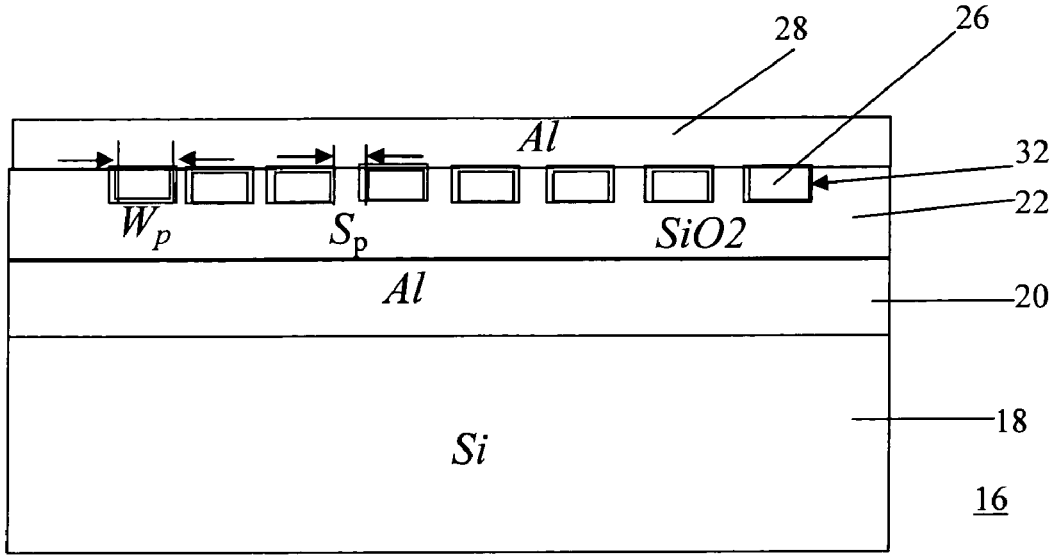
FIG. 2B is a schematic illustration of a transmission line that is loaded with a pattern of ferromagnetic films or bars in accordance with a second preferred embodiment.

Another alternative embodiment of the transmission line 16 is illustrated in FIG. 2B. In this embodiment, a plurality of spaced trenches 32 is etched in the $SiO_2$ layer 22 using an anisotropic $SiO_2$ dry-etch to receive the permalloy bars 26. This provides a planar surface for deposition of the aluminum conductor layer 28. The use of a planar surface can help insure that the width of the deposited aluminum conducted layer 28 is uniform and consistent. As an aside, the test structures formed in accordance with FIG. 2A had some variations in aluminum line width as indicated in Table I below. Use of the planar surface could alleviate this problem. In addition, microposit developer condensate (MDC) may be used to replace MIF300 for pattern definitions because MDC does not etch aluminum. The use of a planar surface will also relieve the over etch requirement for the following etching process. The aluminum transmission line conductor can also be deposited and patterned using the lift-off process.

It should also be understood that the invention is not limited to use with aluminum conductor material. Any other conductor material can be used as well. For example, more advanced interconnect technology uses copper instead of aluminum. Copper does not change the permalloy characteristics. Hence, the theories of the invention still apply when copper is used.

During the tests, 6 different transmission lines were fabricated and analyzed as illustrated in Table I, which shows the dimensions of the test lines. The layout width and length of the A1 transmission lines used in each test were 8 μm and 3814 μm, respectively. Table I lists the measured aluminum line widths and the layout dimensions of the permalloy bars. Large differences in both line inductance and resistance were expected if the proposed FMR and eddy-current loss considerations are correct. Lines 1-4 employed patterned permalloy in accordance with the first preferred embodiment illustrated in FIG. 2A. In these examples, the width of the permalloy film varied from 2 to 16 μm, but the spacing between the permalloy bars was maintained at 2 μm. Line 5 employed a non-patterned permalloy film, while line 6 was a comparison line with no permalloy loading.

TABLE I

| | Permalloy Layout Dimension | | | Measured Aluminum |
|---|---|---|---|---|
| Line | $W_p$ (μm) | $S_p$ (μm) | Length (μm) | Width W (μm) |
| # 1 | 2 | 2 | 10 | ~5.7 |
| # 2 | 4 | 2 | 10 | ~6.2 |
| # 3 | 8 | 2 | 10 | ~7.0 |
| # 4 | 16 | 2 | 10 | ~7.1 |
| # 5 | 3814 | 0 | 10 | ~7.3 |
| # 6 | Comparison line, no permalloy | | | ~7.5 |

As noted before, several non-ideal geometrical features appeared during the fabrication process, notably the line widths of the aluminum in lines 1-4 are smaller than the width of the comparison line 6. However, these did not impede the analysis which verified the theory of the present invention. The obtained transmission line characteristics give clear evidence of the high-frequency operation capability of the permalloy loaded transmission lines and the effectiveness of the FMR and-eddy current control method.

Figure 3:
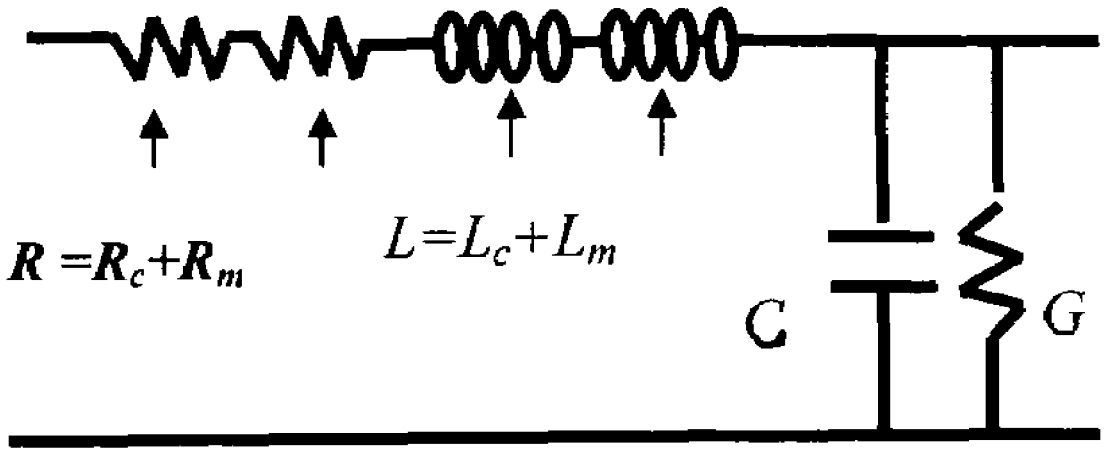
FIG. 3 is a schematic diagram of the equivalent circuit model of the ferromagnetic loaded transmission line of FIG. 2.

The high frequency capabilities of the transmission lines were analyzed using a conventional network analyzer, such as an HP8753E, which can be used to measure the scattering parameters of the transmission lines after short-open-load-through (SOLT) calibrations. A generic RLCG equivalent circuit model of the transmission lines is shown in FIG. 3. The circuit parameters are extracted through the de-embedded scattering parameters.

The simple network representation gives:

$$e^{-\gamma l} = \left\{ \frac{1 - S_{11}^2 + S_{21}^2}{2S_{21}} \pm K \right\}^{-1} \text{ where} \tag{4}$$

$$K = \left\{ \frac{(S_{11}^2 - S_{21}^2 + 1)^2 - (2S_{11})^2}{(2S_{21})^2} \right\}^{\frac{1}{2}} \tag{5}$$

$$Z^2 = Z_0^2 \frac{(1 + S_{11})^2 - S_{21}^2}{(1 - S_{11})^2 - S_{21}^2} \text{ and} \tag{6}$$

$$\begin{aligned} R &= \mathrm{Re}\{\gamma Z\} \\ L &= \mathrm{Im}\{\gamma Z\}/\omega \\ G &= \mathrm{Re}\{\gamma / Z\} \\ C &= \mathrm{Im}\{\gamma / Z\}/\omega. \end{aligned} \tag{7}$$

$S_{ij}$(i, j=1,2) are the scattering parameters, l the length of the lines, and γ the propagation constant.

If one assumes that the thin magnetic film only perturbs the microwave modes slightly, then the conductor line parameters, $R_c$ and $L_c$, can be obtained through a comparison transmission line, which is identical to the test line but without permalloy. $R_m$ and $L_m$, which are the additional resistance and inductance from the magnetic material, can then be extracted. The complex permeability is then obtained through:

$$\begin{aligned} \mu_r'(f) &= 1 + \chi_r'(f) = 1 - \frac{L_m(f)}{L_m(f_0)}(1 - \mu_r'(f_0)) \approx \frac{L_m(f)}{L_m(f_0)}\mu_r'(f_0) \\ \mu_r''(f) &= \chi_r'' = \mu_r'(f)R_m(f)/(\omega L_m(f)) \end{aligned} \tag{8}$$

Equation (8) gives the permeability of the material relative to its value at a lower frequency $f_0$, at which various measurement methods are available. If $f_0$ is low enough (say 50 MHz), the DC permeability may be used in Equation (8) since it has been demonstrated that the permeability is almost constant up to hundreds of MHz for many thin films, including permalloy. Once the line parameters were extracted, they were analyzed as follows. It was shown that the parameters for lines 1-5 intersect or will intersect with the curve of line 6 asymptotically in the high-frequency limit. The larger the permalloy bar, the lower the intersection frequency. For line 1, this frequency was found to be above 20 GHz. The determined frequency response suggests that further narrowing of spacing of the permalloy bars to below 2 μm may be beneficial. Mode conversions might have happened in all the test lines at frequencies above ~22 GHz, where other wide-band test structures may be needed to extract useful information of patterned permalloy structures.

The results may also indicate that more magnetic material results in larger inductance (with a small deviation of line #1). Thus, narrower gaps or spacing between two adjacent permalloy bars will be beneficial for higher inductance because more magnetic material is incorporated. In practice, this means that the gaps should be made as small as practical, which is in the range of 10-20 nanometers up to the 2 μm spacing employed in the test lines 1-4. The line resistances represent the energy losses from a combination of the resistive loss in the aluminum line and the losses in the permalloy bars. These indicate that the larger the permalloy bar cross-section, the stronger the frequency dependence of the energy losses. Thus, line 1 does not have much frequency dependence at all, while line 5 has strong dependence. The low frequency resistance of line 5 is about the same as that of 6. This means that hysteresis loss, which is frequency independent, in the deposited permalloy is not important. In line 1, the weak frequency dependence indicates that the other losses are not significant either.

As discussed earlier, another advantage to using permalloy loaded transmission lines is the magnetic shielding that the permalloy provides. In magnetic field shielding tests in which a test structure using permalloy was compared to a similar structure but without permalloy, it was discovered that the permalloy loaded line has reduced the magnetic coupling by approximately 10 dB. Accordingly, the mutual inductance crosstalk voltage is reduced by approximately 3 times. Thus, the maximum usable line length can be increased. The detailed mutual magnetic field shielding process is complex; the tailoring of the field distribution may be one of the main reasons for the observed reduction of coupling. As noted before, further mutual magnetic field shielding may be achieved by sandwiching the transmission lines with patterned permalloy bars on both sides of the transmission lines as in the modification of the embodiment in FIG. 2A.

The effective permeability by a simplified model shows that the magnetic material layer with a thickness of $t_m$ is approximately equivalent to a layer of thickness $\mu_r t_m$ with $\mu_r$=1 for th magnetic field. The measured DC permeability of the fabricated permalloy film is ~2000. Therefore, the equivalent thickness is large. The ground plane (i.e., the return current path) then seems much farther away than the actual physical path. Furthermore, the return current is more widely spread. Therefore, the equivalent current return path can be approximated at infinity. The partial inductance concept is then acceptable for the inductance modeling consideration. Similarly, the equivalent distance to its neighboring transmission lines is very large. Magnetic field coupling is greatly reduced, and its limitations on the maximum usable interconnect line length and inductance extractions are released.

In the conventional interconnect design, the effects of higher inductances on propagation delay is either advantageous or negligible. The observed mutual magnetic field coupling suppression did not require extra large signal line spacing or additional ground plate. Therefore, the data rate capacity is not reduced. Nevertheless, inclusion of permalloy will reduce the signal transmission velocity of the lines. This reduction is 10% for line #1 from $1/\sqrt{LC}$ estimation and will have an impact on interconnect schemes using pulses.

The analysis of the test transmission lines may be understood with the help of domain analysis, FMR theory and eddy current loss analysis. Closure domains may be formed to minimize the energy density of the permalloy films, in which magnetostatic energy and domain wall energy are the dominant components. The schematic in FIG. 1A is the possible domain structures for line 5. The uncertainties about how many domains might be present or whether there are closure domains do not qualitatively change the following arguments. In line 5, the applied high-frequency magnetic field is perpendicular to the magnetization M, and Equation (2) is applicable. Considering 4πMs=1 T and assuming Hα=⅕ of 4πMs, we obtain $f_r$~4 GHz. This is close to the observed number. Line 5 also appeared to display FMR effects as one might expect. In line 5, Equation (3) is also applicable. The eddy-current contributes to the losses and the spreads of the resonance spectra. It is expected that the eddy-current effects would peak at ~4 GHz, a frequency coinciding with the estimated FMR frequency.

For line 1, the easy axis of the film is along the external high-frequency magnetic field, shown in FIG. 1C. FMR is therefore not an issue if no closure domains occur. Even if there are closure domains, they would be small and FMR would be negligible. As a result, eddy current loss dominates. Equation (3) shows that the loss is effectively reduced by the geometry design. As expected, the frequency performance of lines 2-4 fell somewhere in between the performance of lines 1 and 5. With FMR restrained, such as the situation in lines 1-4 that use the patterned permalloy in accordance with he preferred embodiments, then the limitation of the cross section area is expected to increase the operation frequency range proportionally. The analysis showed that $f_{cut\text{-}off}$~5.5 GHz for line 4. Then Equation (3) shows that for the same eddy-current loss, the frequency for line 1 should be ~16 GHz provided that the skin depths in the 3-dimensional structures are larger than the film thickness. Eddy-current redistributions caused by other effects, such as proximity effects, might limit eddy-current loss further.

In conclusion, it has been established that patterning permalloy on transmission lines extends the application of the transmission lines well into the microwave frequency range by controlling eddy current losses and FMR effects. The patterned permalloy can also effectively reduce the magnetic field coupling, which means the mutual inductance may be ignored for the full-chip inductance matrix extraction and modeling if permalloy is incorporated with the interconnect lines. As a result, the partial inductance method may be appropriate for full chip inductance modeling. Therefore, permalloy loaded transmission lines are feasible for high-speed interconnect applications in deep-sub-micron technologies, such as CMOS Rf IC applications. Additionally, a new technique has been established for extracting frequency dependent permeability values from transmission line parameters to enable easy confirmation that a particular permalloy loaded structure will provide the desired high frequency operation.

Although the invention has been disclosed in terms of preferred embodiments and variations thereon, it will be understood that numerous other variations and modifications could be made thereto without departing from the scope of the invention as set forth in the following claims.

What is claimed is:

1. A transmission line structure for operation at frequencies in excess of 5 GHz comprising:

a first transmission line conductor;

a first plurality of segments of ferromagnetic material, each of said segments being disposed in contact with said transmission line conductor, being spaced from adjacent ones of said segments and having a longitudinal axis that is perpendicular to said transmission line conductor;

a second plurality of segments of ferromagnetic material, each of said segments being disposed in contact with said transmission line conductor on a side opposite to a side on which said first plurality of segments contacts said transmission line conductor, said segments in said second plurality also being spaced from adjacent ones of said segments and having a longitudinal axis that is perpendicular to said transmission line conductor; and a ground plane conductor that is parallel to said transmission line conductor.

2. The structure of claim 1 in which said ferromagnetic material is permalloy.

3. The structure of claim 1, wherein said segments of ferromagnetic material are spaced from said ground plane conductor by a layer of insulation.

4. The structure of claim 1, wherein each of said segments is rectangular in shape.

5. The structure of claim 4, wherein each of said segments has a width of no more than 2 μm and said segments are spaced from one another by between 10 nanometers and 2 μm.

6. A method for fabricating a transmission line that enables high frequency operation of the line in excess of 5 GHz through control of ferromagnetic resonance and eddy current effects, said method comprising the steps of:

depositing a pattern of ferromagnetic material on a layer of insulation, said pattern including a plurality of spaced segments, said segments being spaced and sized to control domain structures in said segments such that said domain structures are oriented in a direction that is perpendicular to a longitudinal axis of a transmission line conductor to be formed on said pattern of ferromagnetic material;

forming said transmission line conductor on said pattern of ferromagnetic material;

measuring scattering parameters for said line using a network analyzer;

extracting circuit parameters from said scattering parameters;

determining the resistance and inductance parameters of a comparison transmission line that has no ferromagnetic material loading;

subtracting the resistance and inductance parameters for said comparison line from those for said ferromagnetic material loaded line to thereby determine the resistance and inductance parameters of the ferromagnetic material alone; and employing the resistance and inductance parameters of the ferromagnetic material in a formula for calculating the permeability of the ferromagnetic loading material as a function of frequency.

7. A method for fabricating a transmission line that enables high frequency operation of the line in excess of 5 GHz through control of ferromagnetic resonance and eddy current effects, said method comprising the steps of:

depositing a pattern of ferromagnetic material in a corresponding on a layer of insulation, said pattern including a plurality of spaced segments, said segments being spaced and sized to control domain structures in said segments such that said domain structures are oriented in a direction that is perpendicular to a longitudinal axis of a transmission line conductor to be formed on said pattern of ferromagnetic material; and depositing a second pattern of ferromagnetic material on said transmission line conductor, said second pattern also including a plurality of spaced segments, said segments being spaced and sized to control domain structures in said segments such that said domain structures are oriented in a direction that is perpendicular to a longitudinal axis of said transmission line conductor.

8. A method for fabricating a transmission line that enables high frequency operation of the line in excess of 5 GHz through control of ferromagnetic resonance and eddy current effects, said method comprising the steps of:

depositing a pattern of ferromagnetic material in a corresponding plurality of trenches formed in a layer of insulation to thereby form a planar surface for reception of said transmission line conductor, said pattern including a plurality of spaced segments, said segments being spaced and sized to control domain structures in said segments such that said domain structures are oriented in a direction that is perpendicular to a longitudinal axis of a transmission line conductor to be formed on said pattern of ferromagnetic material; and forming said transmission line conductor on said pattern of ferromagnetic material.

9. The method of claim 8, further comprising the steps of first forming a ground plane conductor of said transmission line on a substrate and then forming said layer of insulation on said ground plane conductor.

10. A transmission line structure for operation at frequencies in excess of 5 GHz comprising:

a ground plane conductor;

a layer of insulation disposed on said ground plane conductor and having a plurality of trenches formed therein;

a plurality of segments of ferromagnetic material each disposed in a corresponding one of a plurality of trenches in said layer of insulation, thereby forming a planar top surface of said layer of insulation, said segments of ferromagnetic material being spaced from adjacent ones of said segments and having a longitudinal axis that is perpendicular to said ground plane conductor; and a transmission line conductor that is parallel to said ground plane conductor and is disposed on said planar top surface of said insulation and in contact with said segments of ferromagnetic material.

11. The structure of claim 10 in which said ferromagnetic material is permalloy.

12. The structure of claim 10, wherein each of said segments is rectangular in shape.

13. The structure of claim 12, wherein each of said segments has a width of no more than 16 μm and said segments are spaced from one another by between 10 nanometers and 2 μm.

14. A transmission line structure for operation at frequencies in excess of 5 GHz comprising:

a first transmission line conductor;

a plurality of rectangular segments of ferromagnetic material, each of said segments being disposed in contact with said transmission line conductor, being spaced from adjacent ones of said segments, having a width of no greater than 16 μm and having a longitudinal axis that is perpendicular to said transmission line conductor; and a ground plane conductor that is parallel to said transmission line conductor.

15. The structure of claim 14 in which said ferromagnetic material is permalloy.

16. The structure of claim 14, wherein said segments of ferromagnetic material are spaced from said ground plane conductor by a layer of insulation.

17. The structure of claim 14, wherein each of said segments has a width of no more than 2 μm and said segments are spaced from one another by between 10 nanometers and 2 μm.

18. The structure of claim 16 in which said segments of ferromagnetic material are each disposed in a corresponding one of a plurality of trenches in said layer of insulation, thereby forming a planar top surface of said layer of insulation on which said transmission line conductor is disposed.

* * * * *